US006824387B2

(12) United States Patent
Sakai et al.

(10) Patent No.: US 6,824,387 B2
(45) Date of Patent: Nov. 30, 2004

(54) MIRROR FOR CHECKING DYED HAIR COLOR

(75) Inventors: Masahiko Sakai, Tokyo (JP); Satoshi Onitsuka, Tokyo (JP); Mitsuo Asano, Tokyo (JP)

(73) Assignee: Kao Corporation, Tokyo (JP)

( * ) Notice: Subject to any disclaimer, the term of this patent is extended or adjusted under 35 U.S.C. 154(b) by 314 days.

(21) Appl. No.: 10/019,015

(22) PCT Filed: Apr. 23, 2001

(86) PCT No.: PCT/JP01/03447

§ 371 (c)(1),
(2), (4) Date: Dec. 26, 2001

(87) PCT Pub. No.: WO01/80685

PCT Pub. Date: Nov. 1, 2001

(65) Prior Publication Data

US 2003/0081332 A1 May 1, 2003

(30) Foreign Application Priority Data

Apr. 24, 2000 (JP) ..... 2000-123240
Jul. 4, 2000 (JP) ..... 2000-202523

(51) Int. Cl.[7] ..... G09B 19/10
(52) U.S. Cl. ..... 434/94; 434/102
(58) Field of Search ..... 434/94, 365, 371, 434/377, 98, 102

(56) References Cited

U.S. PATENT DOCUMENTS 4,297,724 A * 10/1981 Masuda et al. ..... 348/77
4,500,169 A * 2/1985 Donnelly ..... 359/871
4,776,796 A * 10/1988 Nossal ..... 434/94

FOREIGN PATENT DOCUMENTS

| | | |
|---|---|---|
| GB | 2 000 021 | 1/1979 |
| JP | 98821/1984 | 7/1984 |
| JP | 9-37846 | 2/1997 |

* cited by examiner

*Primary Examiner*—Kien T. Nguyen
(74) *Attorney, Agent, or Firm*—Oblon, Spivak, McClelland, Maier & Neustadt, P.C.

(57) ABSTRACT

A mirror for checking dyed hair color has a mirror and a colored filter formed on part or the whole of the surface of the mirror. The colored filter is formed such that the color of the reflected image of hair from the colored filter is the same as the dyed hair color for when the hair has been dyed with a particular hair dye. By using this mirror for checking dyed hair color, it is possible to easily predict hair color after dyeing for any given initial hair color, thus making it possible to easily select a hair dye for obtaining a desired dyed hair color.

19 Claims, 4 Drawing Sheets

Sectional view along with line x–x

MIRROR FOR CHECKING DYED HAIR COLOR

TECHNICAL FIELD

The present invention relates to a mirror for checking dyed hair color that is useful in selecting a hair dye that makes hair a desired dyed hair color, and a method of selecting a hair dye using this mirror for checking dyed hair color.

BACKGROUND ART

Hair dyes are used for changing hair to a desired color to hide gray or white hair or as a fashion means. Types of hair dyes are temporary hair dyes that are simple to use but give poor color retention, semi-permanent hair dyes for which a direct dye such as an acid dye is made to penetrate into the inside of the hair, thus allowing a lasting dyed hair effect to be obtained, and permanent hair dyes for which oxidative polymerization of a dye is carried out within the hair, thus allowing a more-or-less permanent dyed hair effect to be obtained; the type of hair dye used depends on the purpose.

For example, to dye hair from its original color to a desired color, a permanent hair dye or semi-permanent hair dye is first used, and then once the dyed hair color has faded due to shampooing, exposure to sunlight and the like, or the color of the roots has become conspicuous due to the hair growing, dyeing with the permanent hair dye or semi-permanent hair dye is carried out once again.

The hair color after dyeing is not determined only by the inherent color of the hair dye, but is also influenced by the color of the hair before dyeing. For example, even if hair dye of the same color is used, the dyed hair color after dyeing will vary considerably according to whether the hair color before dyeing was blonde or brown, or even light blonde or dark blonde. Moreover, even if hair dye of the same color is used, the hair color after dyeing will be different in the case of dyeing for the first time and the case of re-dyeing dyed hair after the color has faded. As a result of the above, it is not easy to predict hair color after dyeing in the general case. In particular, in the case of dyeing gray or white hair with a semi-permanent hair dye containing a direct dye, the hair color after dyeing can be predicted just from the color of the semi-permanent hair dye itself, but in the case of dyeing natural blonde hair, hair for which the color has faded after dyeing with a permanent hair dye, bleached hair or the like with a semi-permanent hair dye, it is difficult to predict the hair color after dyeing.

The color of a hair dye tends to be displayed by printing a color sample on the product packaging box or the like, or by providing a tress containing hair colored to the color of the hair dye in question near to a display shelf holding the product. However, it is difficult to predict the hair color after dyeing for any given initial hair color by means of only such a display, and thus a problem arises in that the hair color after dyeing may be different from that predicted.

In view of such a problem, an object of the present invention is to make it possible to easily predict hair color after dyeing for any given initial hair color, thus making it possible to easily select a hair dye for obtaining a desired dyed hair color.

DISCLOSURE OF THE INVENTION

The inventors of the present invention arrived at the present invention after discovering that, to attain the above-mentioned object, it is useful to be able to view using a mirror the dyed hair color for when hair has been dyed with a particular hair dye, and hence that at least one colored filter corresponding to a particular hair dye is formed on part or the whole of the surface of the mirror, so that a reflected image of hair having a color the same as when dyed with the particular hair dye can be viewed, preferably together with a reflected image of the hair having the actual present hair color, is useful for checking dyed hair color.

Specifically, according to the present invention, a mirror for checking dyed hair color is provided that comprises a mirror and a colored filter formed on part or the whole of a surface of said mirror, wherein said colored filter is formed such that the color of a reflected image of hair from said colored filter is substantially the same as a dyed hair color for when said hair has been dyed with a particular hair dye.

In particular, an embodiment is provided in which, in the mirror for checking dyed hair color, the colored filter comprises a transparent colored adhesive layer and a transparent cover film formed on this transparent colored adhesive layer. Moreover, a method of manufacturing this mirror for checking dyed hair color is provided in which a transparent colored adhesive is applied onto one surface of a transparent cover film, and then the transparent cover film is stuck onto a mirror, with the surface on which the transparent colored adhesive has been applied being on the mirror side.

Moreover, a method of selecting a hair dye for making hair a desired dyed hair color is provided, comprising the steps of viewing hair using a mirror for checking dyed hair color, and thus obtaining a reflected image of the hair having a color as when dyed from a part of the mirror on which the colored filter is formed, preferably at the same time as a reflected image of the hair having the actual present hair color from a part of the mirror on which no colored filter is formed.

BEST MODE FOR CARRYING OUT THE INVENTION

Figure 1:
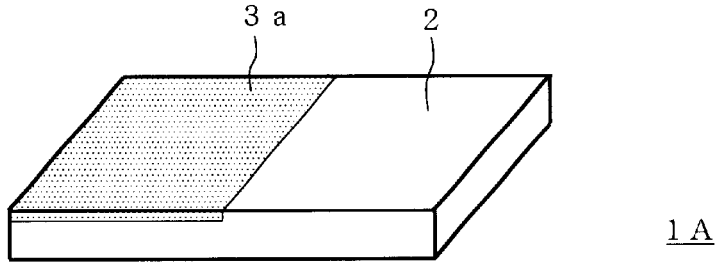
FIG. 1 is a perspective view of a mirror for checking dyed hair color.

Following is a detailed description of the present invention with reference to the drawings. Note that equivalent constituent elements are represented by the same reference numeral throughout the drawings.

Figure 2:
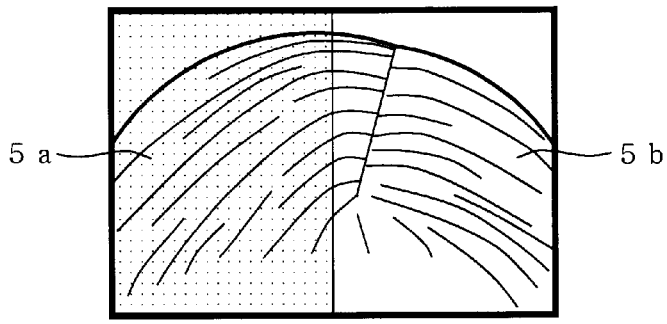
FIG. 2 is a drawing showing an image of hair viewed using a mirror for checking dyed hair color.

FIG. 1 is a perspective view of an embodiment of the mirror for checking dyed hair color of the present invention, while FIG. 2 is a drawing showing an image of hair viewed using this mirror for checking dyed hair color 1A.

The mirror for checking dyed hair color 1A comprises a mirror 2 and a colored filter 3*a* formed so as to cover about half of the surface of the mirror 2.

The mirror 2 comprises a dyeable plastic plate made of an acrylic resin, a polycarbonate, a methacrylic resin or the like.

The colored filter 3*a* is formed as a dyed layer formed by dyeing the surface of the plastic plate that constitutes the mirror 2 with dyes such as disperse dyes or acid dyes. A suitable combination of dyes of colors such as red, green, purple, purplish red, brown and gold is used such that the reflected image of hair of any given color from the colored filter 3*a* will have a dyed hair color the same as if the hair had been dyed with a particular hair dye.

When a reflected image of hair is viewed using the mirror for checking dyed hair color 1A, as shown in FIG. 2, a dyed hair color image 5*a* is seen from the part of the mirror on which the colored filter 3*a* is formed, while an actual present hair color image 5*b* is seen from the part of the mirror on which the colored filter 3*a* is not formed. It is thus possible to simultaneously view and hence compare the dyed hair color image 5*a* and the actual present hair color image 5*b*, and thus clearly check how the color will change if the hair in its present state is dyed with the hair dye in question. By viewing the hair in this way using a plurality of mirrors for checking dyed hair color each of which has formed thereupon a colored filter corresponding to a different hair dye, a hair dye for making the hair a desired dyed hair color can be selected easily and reliably. The present invention thus includes a method of selecting a hair dye using mirrors for checking dyed hair color.

Note that it is preferable to form the colored filter 3*a* from a dyed layer on the surface of the mirror 2 as described above, since in this case scattering of light from the surface of the colored filter 3*a* can be suppressed, and hence a clear dyed hair color image 5*a* can be obtained from the colored filter 3*a*.

Figure 3:
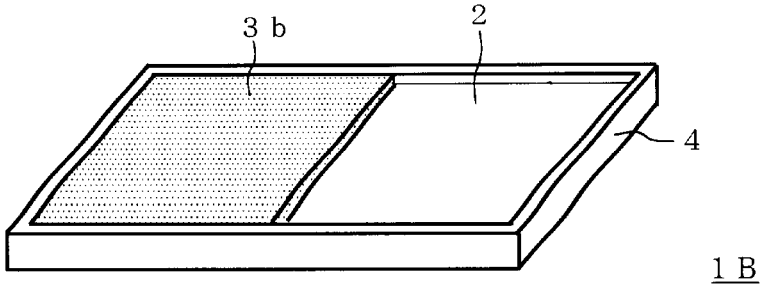
FIG. 3 is a perspective view of a mirror for checking dyed hair color.

FIG. 3 is a perspective view of a mirror for checking dyed hair color 1B according to another embodiment of the present invention. This mirror for checking dyed hair color 1B also comprises a mirror 2 and a colored filter 3*b* provided so as to cover about half of the surface of the mirror 2. However, in the case of this mirror for checking dyed hair color 1B, the mirror 2 is made of glass or any plastics, and a transparent plastic or glass cell filled with a colored liquid is used as the colored filter 3*b*. Reference numeral 4 in FIG. 3 represents a frame that is provided as necessary.

The method of forming the colored filter 3*b* is, for example, to prepare a solution of suitable concentration of a hair dye and then fill the transparent cell with this solution, or to prepare a dye solution of a suitable concentration composed of acid dyes, basic dyes or the like of colors such as red, green, purple, purplish red, brown and gold and then fill the transparent cell with this dye solution.

Figure 4A:
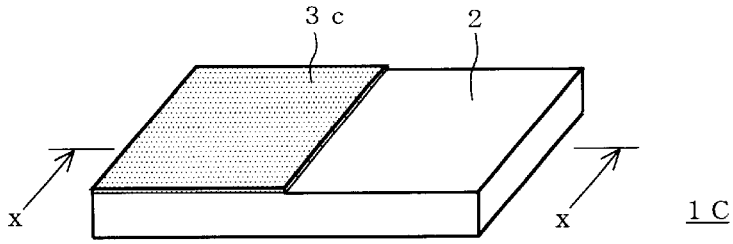
FIGS. 4A and 4B are perspective and sectional views respectively of a mirror for checking dyed hair color.
Figure 4B:
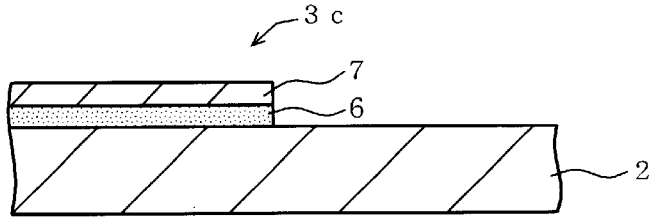

FIGS. 4A and 4B are perspective and sectional views respectively of a mirror for checking dyed hair color 1C according to yet another embodiment of the present invention.

This mirror for checking dyed hair color 1C again comprises a mirror 2 and a colored filter 3*c* formed so as to cover about half of the surface of the mirror 2.

In this mirror for checking dyed hair color 1C, an ordinary glass mirror, a plastic plate or plastic film having a vapor deposited metal film formed on one surface thereof, or a mirror-surface-finished metal or metal foil or the like can be used as the mirror 2. From the point of view of ease of handling of the mirror for checking dyed hair color 1C, however, it is preferable to use a plastic plate or plastic film having a vapor deposited metal film formed on one surface thereof.

The colored filter 3*c* comprises a transparent colored adhesive layer 6 and a transparent cover film 7 formed on the transparent colored adhesive layer 6.

The transparent colored adhesive layer 6 comprises a transparent colored adhesive that comprises a pressure sensitive adhesive such as an acrylic adhesive, an adhesive for dry lamination, a heat sensitive adhesive or the like colored with one or more of various dyes such as disperse dyes, acid dyes or direct dyes. Regarding the colors of the dyes, dyes of colors such as red, green, purple, purplish red, brown and gold are suitably combined so that the color of the reflected image of the hair, the skin or the like from the colored filter 3*c* is as if the hair, the skin or the like had been colored with a particular coloring cosmetic. Moreover, to improve the light-fastness of the color given to the transparent colored adhesive layer 6, an ultraviolet absorber can be added to the transparent colored adhesive.

The transparent cover film 7 is used as a base sheet upon which the transparent colored adhesive is applied when forming the transparent colored adhesive layer 6 as described below. Moreover, the transparent cover film 7 also functions as a surface-protecting layer for maintaining the smoothness of the surface of the colored filter 3*c*. A PET film, an OPP film or the like of thickness 10 to 50 $\mu$m can be used as the transparent cover film 7.

The method of manufacturing the mirror for checking dyed hair color 1C is to apply the transparent colored adhesive onto one surface of the transparent cover film 7 by roll coating or the like, and then stick the transparent cover film 7 onto the mirror 2, with the surface on which the transparent colored adhesive has been applied being on the mirror side.

So long as the mirror for checking dyed hair color of the present invention has formed on part or the whole of the surface thereof at least one colored filter that gives a reflected image of hair having a color the same as the dyed hair color that would be obtained by dyeing the hair with a particular hair dye, the mirror for checking dyed hair color of the present invention can take any of various forms other than the forms shown in the drawings. For example, the colored filter may be formed by sticking onto a mirror a plastic sheet colored with a suitable combination of dyes of colors such as red, green, purple, purplish red, brown and gold so as to be colored to the color of the hair dye in question, or by printing a dye coating film or the like onto a mirror. Moreover, the colored filter may be formed as a colored layer formed by carrying out transparent plating or impregnation printing using a special ink having a sublimable dye as a base. In all cases, the coloring capability of the colored filter can be adjusted through the concentration of the dyes and also through the thickness of the colored filter.

Note that, if the colored filter 3*c* is formed from a transparent colored adhesive layer 6 and a transparent cover film 7 formed on the transparent colored adhesive layer 6 as in the case of the mirror for checking dyed hair color 1C described above, then the amounts of the dyes and solvents used in preparing the transparent colored adhesive can be finely adjusted as appropriate on the production line, and hence discrepancies in color between lots can be eliminated more easily than when a transparent colored film is stuck onto a mirror; moreover, a reflected image giving a sensation of transparency can be obtained more easily than when the surface of a mirror is dyed with a colored ink. Accordingly, the embodiment in which a transparent colored adhesive is used is preferable, since mirrors for checking dyed hair color each having a colored region having a color as intended can be manufactured cheaply and continuously ('roll-to-roll').

In the present invention, there are no particular limitations on the size of the colored filter, but to make it easy to visually compare the part of the reflected hair image having the hair color as when dyed and the part of the reflected hair image having the actual present hair color, it is preferable for the part of the reflected hair image having the hair color as when dyed and the part of the reflected hair image having the actual present hair color to each account for about half of the reflected hair image, and thus for the colored filter to be formed so as to cover about one third to two thirds of the mirror.

Figure 5:
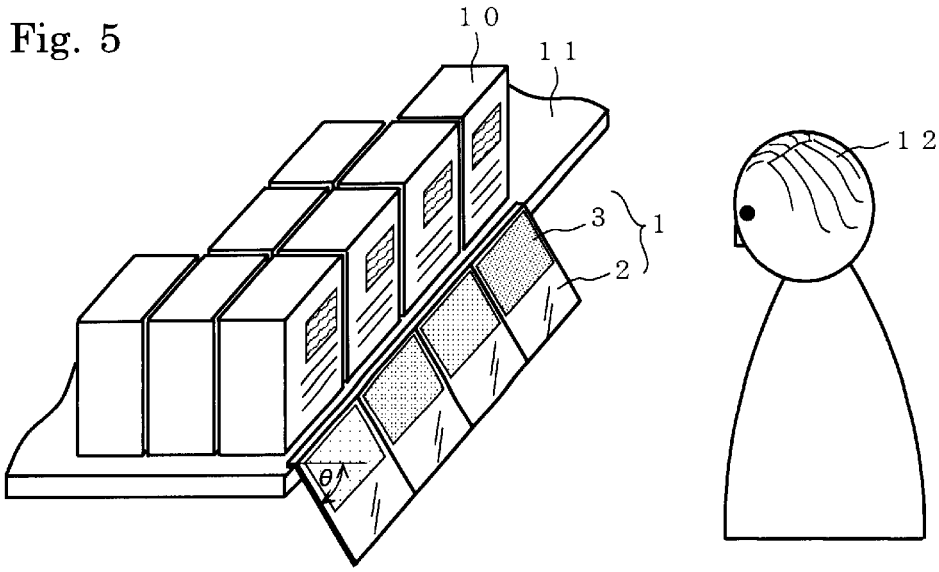
FIG. 5 is a drawing showing a way of using a mirror for checking dyed hair color in a shop.

It is preferable to be able to use the mirror for checking dyed hair color of the present invention any time that one wants to check in advance a hair color that hair will become if dyed with a particular hair dye. As shown in FIG. 5, it is preferable that different mirrors for checking dyed hair color 1 (i.e. the mirrors for checking dyed hair color 1A, 1B, 1C and the like) for different colors of various hair dye products 10 are attached to a display member 11 such as a display shelf or display stand holding the product 10. In this case, the mirror for checking dyed hair color 1 is preferably attached such that the attachment angle θ relative to the display surface is variable, thus allowing any viewer 12 to easily view the reflected image from the mirror for checking dyed hair color 1.

Figure 6A:
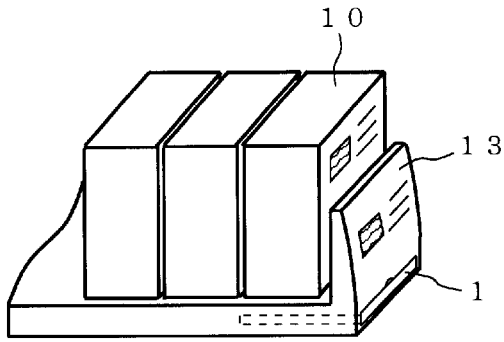
FIGS. 6A and 6B are drawings showing a way of using a mirror for checking dyed hair color in a shop.
Figure 6B:
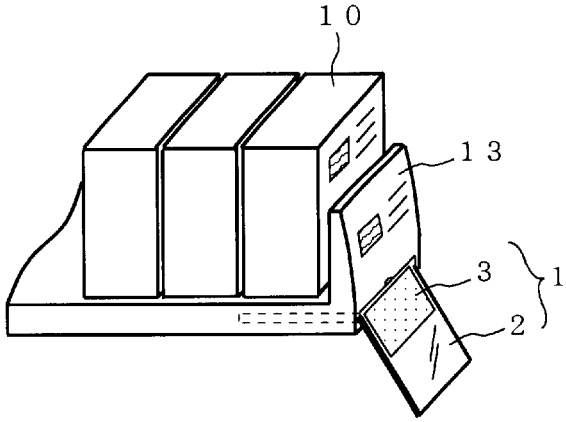

Moreover, it is also possible to house the mirror for checking dyed hair color 1 in the base of a display tray 13 holding the product 10 as shown in FIG. 6A, with it being possible to pull out the mirror for checking dyed hair color 1 when needed as shown in FIG. 6B.

Figure 7:
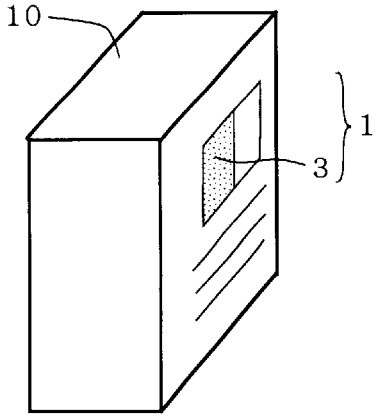
FIG. 7 is a perspective view of a packaging box on which a mirror for checking dyed hair color is stuck.

The mirror for checking dyed hair color 1 may also be directly stuck onto a side face of the product 10 as shown in FIG. 7.

Figure 8:
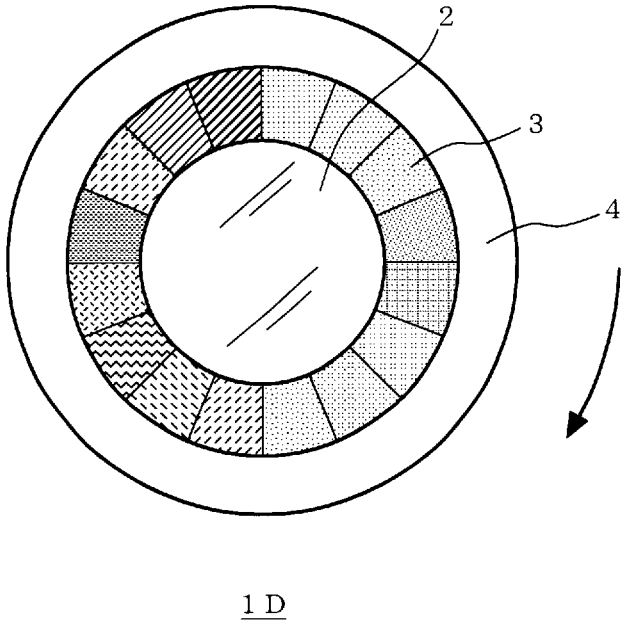
FIG. 8 is a front view of a mirror for checking dyed hair color.

Furthermore, with the mirror for checking dyed hair color of the present invention, it is also possible to provide a plurality of colored filters of different colors next to one another on the surface of the mirror. For example, as shown in FIG. 8, a mirror for checking dyed hair color 1D can be formed from a disk-shaped mirror 2 and a plurality of colored filters 3 (3*a*, 3*b*, 3*c* etc.) of different colors arranged around the periphery of the disk-shaped mirror 2, with a frame 4 also being provided as necessary. According to this mirror for checking dyed hair color 1D, by rotating the mirror for checking dyed hair color 1D as shown by the arrow in FIG. 8 with one's face reflected in the central part of the mirror 2, the dyed hair color for when one's hair has been dyed with various particular hair dyes can be viewed via the colored filters 3 of the various colors, and at the same time one's present hair color can be viewed from one's bangs, sideburns or the like reflected in the part of the mirror 2 on which no colored filters 3 are formed, thus allowing comparison of all of these hair colors.

EXAMPLES

Examples 1

Manufacture of Mirrors for Checking Dyed Hair Color (1) Half of the surface of a transparent acrylic mirror (external dimensions: 90 mm×110 mm; plate thickness: 3 mm) was covered with vinyl tape, and then this half of the mirror was immersed in a liquid containing red, orange and purple disperse dyes and a dyeing auxiliary (immersion temperature: 70° C.; immersion time: 5 minutes) and then removed from the liquid, thus manufacturing a mirror for checking dyed hair color having a red colored filter formed on half thereof and no colored filter formed on the remaining half thereof.

(2) A mirror for checking dyed hair color having a purple colored filter was manufactured as in (1) above but using a purple disperse dye as the dye.

(3) A mirror for checking dyed hair color having a brown colored filter was manufactured as in (1) above but using orange, purple and yellow disperse dyes as the dyes.

(4) A mirror for checking dyed hair color having a green colored filter was manufactured as in (1) above but using purple, yellow and orange disperse dyes as the dyes.

Examples 2

Re-Dyeing of Dyed Hair After the Color has Faded (1) A swatch (bundle of hair) made from human hair was dyed a brown color (L=23.2, a=3.4, b=4.8 under the Lab color system) by treating with a permanent hair dye.

The swatch was then repeatedly shampooed, rinsed and conditioned so as to fade the color. After this fading treatment, the hair had become a reddish brown color (L=28.9, a=6.6, b=8.5).

The hair was then viewed using the mirror for checking dyed hair color of Example 1(3), whereupon the color of the reflected hair image from the colored filter appeared to be the same as the color of the hair before the fading treatment (specifically, L=24.0, a=3.2, b=4.6).

The hair was then dyed with a hair dye corresponding to the colored filter of the mirror for checking dyed hair color, whereupon the color was restored to the color before the fading treatment (specifically, L=23.6, a=3.0, b=4.6).

Ten expert panelists were asked to view the reflected image of a swatch subjected to the fading treatment from the mirror for checking dyed hair color of Example 1(3) and hair subjected to the fading treatment and then dyed with the hair dye corresponding to the colored filter of this mirror for checking dyed hair color, and evaluate whether the respective colors were the same or different. All of the panelists judged that there was no difference between the colors.

(2) A swatch made from human hair was dyed a blonde color (L=42.5, a=5.5, b=8.7 under the Lab color system) by treating with a permanent hair dye, and was then subjected to fading treatment as in (1) above, whereupon the color faded, becoming L=49.2, a=3.2, b=13.7.

The hair was then viewed using the mirror for checking dyed hair color of Example 1(2), whereupon the color of the reflected hair image from the colored filter appeared to be the same as the color of the hair before the fading treatment (specifically, L=41.0, a=4.9, b=9.1).

The hair was then dyed with a hair dye corresponding to the colored filter of the mirror for checking dyed hair color, whereupon the color was restored to the color before the fading treatment (specifically, L=41.5, a=4.8, b=8.8).

As in (1) above, ten expert panelists were asked to evaluate whether the color of the reflected image of a swatch subjected to the fading treatment viewed using the mirror for checking dyed hair color and the color of hair subjected to the fading treatment and then dyed with the hair dye corresponding to the colored filter of the mirror for checking dyed hair color were the same or different. All of the panelists judged that there was no difference between the colors.

(3) A swatch made from human hair was dyed an orangey brown color (L=24.8, a=5.7, b=6.6 under the Lab color system) by treating with a permanent hair dye, and was then subjected to fading treatment as in (1) above, whereupon the color faded, becoming L=28, a=5.5, b=9.0.

The hair was then viewed using the mirror for checking dyed hair color of Example 1(1), whereupon the color of the reflected hair image from the colored filter appeared to be the same as the color of the hair before the fading treatment (specifically, L=24.8, a=5.8, b=6.3).

The hair was then dyed with a hair dye corresponding to the colored filter of the mirror for checking dyed hair color, whereupon the color was restored to the color before the fading treatment (specifically, L=24.9, a=5.6, b=6.7).

As in (1) above, ten expert panelists were asked to evaluate whether the color of the reflected image of a swatch subjected to the fading treatment viewed using the mirror for checking dyed hair color and the color of hair subjected to the fading treatment and then dyed with the hair dye corresponding to the colored filter of the mirror for checking dyed hair color were the same or different. All of the panelists judged that there was no difference between the colors.

Examples 3

Re-Dyeing of Dyed Hair After the Color has Faded

Eight mirrors for checking dyed hair color having colored filters of different colors to one another were manufactured as in Examples 1.

Twenty hair dye users were taken as panelists, with each having dyed hair for which the color had faded. Each of the panelists was asked to use the eight mirrors for checking dyed hair color and select one having a colored filter that made his/her hair look as if it had been restored to the color before fading, and then dye his/her hair with a hair dye corresponding to the colored filter in question.

Each panelist was asked to evaluate the following items, with five levels of answer being allowed as shown in Table 1.

(1) The ease of predicting dyed hair color using the mirror for checking dyed hair color.

(2) The agreement between the dyed hair color predicted using the mirror for checking dyed hair color and the actual dyed hair color.

(3) When restoring faded dyed hair to the dyed hair color before fading, how good predicting the dyed hair color using the mirror for checking dyed hair color of the present invention and then dyeing is compared with predicting the dyed hair color using a conventional color sample attached to a hair dye product and then dyeing.

The proportion of the panelists giving each answer for each item was then calculated. It can be seen from Table 1 that the performance of the mirror for checking dyed hair color of the present invention in predicting dyed hair color is far superior to that of a conventional color sample.

TABLE 1

| | Good | Somewhat good | Medium | Somewhat poor | Poor |
|---|---|---|---|---|---|
| (1) Ease of predicting dyed hair color | 90% | 10% | — | — | — |
| (2) Agreement between predicted dyed hair color and actual dyed hair color | 90% | 10% | — | — | — |
| (3) How good compared with conventional color sample | 100% | — | — | — | — |

Examples 4

Figure 9:
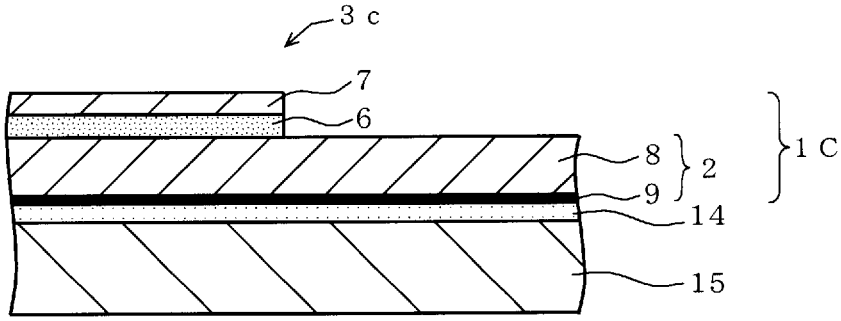
FIG. 9 is a sectional view of a mirror for checking dyed hair color according to an example of the present invention.

A mirror for checking dyed hair color 1C having the layer structure shown in FIG. 9 was manufactured as follows.

Firstly, as the mirror 2, a film-type mirror was obtained by forming a vapor deposited aluminum film 9 on one surface of a transparent PET film 8 (thickness 175 μm).

Moreover, a transparent colored adhesive was prepared by mixing disperse dyes into an acrylic pressure sensitive adhesive such that the color of a reflected hair image from a region of the mirror for checking dyed hair color 1C upon which a colored filter 3*c* was formed would match the dyed hair color after dyeing. A transparent colored adhesive layer 6 (coating thickness a few μm) was then formed by roll-coating the transparent colored adhesive onto one surface of a transparent PET film (thickness 25 μm) to be used as a transparent cover film 7, and then the transparent cover film 7 was compression-bonded onto part of the film-type mirror 2 with the surface of the transparent cover film 7 on which the transparent colored adhesive layer 6 had been applied coming into contact with the transparent PET film 8 of the film-type mirror 2, thus obtaining the mirror for checking dyed hair color 1C, which was then cut into a rectangular shape of side 6 cm (with the colored region accounting for about half of the mirror for checking dyed hair color 1C).

An acrylic pressure sensitive adhesive 14 was then applied onto one surface of a piece of release paper, and the release paper with the acrylic pressure sensitive adhesive 14 applied thereon was stuck onto the surface of the vapor deposited aluminum film 9 of the mirror for checking dyed hair color 1C. The release paper was then peeled off, and the mirror for checking dyed hair color 1C was stuck onto a side face of a paper hair dye packaging box 15, thus producing the structure shown in FIG. 9.

INDUSTRIAL APPLICABILITY

By using the mirror for checking dyed hair color of the present invention, it is possible to easily and reliably predict hair color after dyeing for any given initial hair color.

In particular, the mirror for checking dyed hair color of the present invention is useful in predicting, for example, the hair color after dyeing chromatic color hair such as natural blonde hair with a semi-permanent hair dye, the hair color after re-dyeing, with a semi-permanent hair dye, hair for which the color has faded after being dyed chromatic color such as blonde with a permanent hair dye, and the hair color after dyeing bleached hair with a semi-permanent hair dye.

By using the mirror for checking dyed hair color of the present invention, it is easy to select a hair dye for obtaining a desired dyed hair color.

What is claimed is:

1. A mirror for checking dyed hair color, comprising:

a mirror; and a colored filter formed on part or the whole of a surface of said mirror;

wherein said colored filter is formed such that the color of a reflected image of hair from said colored filter is substantially the same as a dyed hair color for when said hair has been dyed with a particular hair dye, and wherein said colored filter comprises a transparent plastic or glass cell filled with a colored liquid which is secured to the surface of said mirror with a frame.

2. The mirror for checking dyed hair color according to claim 1, wherein said mirror for checking dyed hair color is installed on a member for displaying a hair dye product.

3. A method of selecting a hair dye for making hair a desired dyed hair color, comprising the steps of:

viewing hair of a subject using the mirror for checking dyed hair color according to claim 2; and obtaining a reflected image of said hair having a color substantially the same as said dyed hair color from a part of said mirror on which a colored filter is formed.

4. The method of selecting a hair dye according to claim 3, wherein a reflected image, from said part of said mirror on which said colored filter is formed, of said hair having a color substantially the same as said dyed hair color, and a reflected image, from a part of said mirror on which no colored filter is formed, of said hair having the actual present color of said hair, are obtained simultaneously.

5. A method of selecting a hair dye for making hair a desired dyed hair color, comprising the steps of:

viewing hair of a subject using the mirror for checking dyed hair color according to claim 1; and obtaining a reflected image of said hair having a color substantially the same as said dyed hair color from a part of said mirror on which a colored filter is formed.

6. The method of selecting a hair dye according to claim 5, wherein a reflected image, from said part of said mirror on which said colored filter is formed, of said hair having a color substantially the same as said dyed hair color, and a reflected image, from a part of said mirror on which no colored filter is formed, of said hair having the actual present color of said hair, are obtained simultaneously.

7. A mirror for checking dyed hair color, comprising:

a mirror; and a colored filter formed on part or the whole of a surface of said mirror;

wherein said colored filter is formed such that the color of a reflected image of hair from said colored filter is substantially the same as a dyed hair color for when said hair has been dyed with a particular hair dye, and wherein said mirror comprises a plastic plate, and said colored filter comprises a dyed layer that is formed by coloring said plastic plate.

8. The mirror for checking dyed hair color according to claim 7, wherein said mirror for checking dyed hair color is installed on a member for displaying a hair dye product.

9. A method of selecting a hair dye for making hair a desired dyed hair color, comprising the steps of:

viewing hair of a subject using the mirror for checking dyed hair color according to claim 7, and obtaining a reflected image of said hair having a color substantially the same as said dyed hair color from a part of said mirror on which a colored filter is formed.

10. The method of selecting a hair dye according to claim 9, wherein a reflected image, from said part of said mirror on which said colored filter is formed, of said hair having a color substantially the same as said dyed hair color, and a reflected image, from a part of said mirror on which no colored filter is formed, of said hair having the actual present color of said hair, are obtained simultaneously.

11. A mirror for checking dyed hair color, comprising:

a mirror; and a colored filter formed on part or the whole of a surface of said mirror;

wherein said colored filter is formed such that the color of a reflected image of hair from said colored filter is substantially the same as a dyed hair color for when said hair has been dyed with a particular hair dye, and wherein said colored filter comprises a transparent colored adhesive layer and a transparent cover film formed on said transparent colored adhesive layer.

12. The mirror for checking dyed hair color according to claim 11, wherein said mirror comprises a plastic plate or plastic film having a thin metal film formed on one surface thereof.

13. The mirror for checking dyed hair color according to claim 12, wherein said mirror for checking dyed hair color is installed on a member for displaying a hair dye product.

14. A method of selecting a hair dye for making hair a desired dyed hair color, comprising the steps of:

viewing hair of a subject using the mirror for checking dyed hair color according to claim 12; and obtaining a reflected image of said hair having a color substantially the same as said dyed hair color from a part of said mirror on which a colored filter is formed.

15. The method of selecting a hair dye according to claim 14, wherein a reflected image, from said part of said mirror on which said colored filter is formed, of said hair having a color substantially the same as said dyed hair color, and a reflected image, from a part of said mirror on which no colored filter is formed, of said hair having the actual present color of said hair, are obtained simultaneously.

16. A method of manufacturing the mirror for checking dyed hair color according to claim 11, comprising the steps of:

applying a transparent colored adhesive onto one surface of a transparent cover film; and sticking said transparent cover film onto said mirror, with said surface on which said transparent colored adhesive has been applied being on the mirror side.

17. The mirror for checking dyed hair color according to claim 11, wherein said mirror for checking dyed hair color is installed on a member for displaying a hair dye product.

18. A method of selecting a hair dye for making hair a desired dyed hair color, comprising the steps of:

viewing hair of a subject using the mirror for checking dyed hair color according to claim 11; and obtaining a reflected image of said hair having a color substantially the same as said dyed hair color from a part of said mirror on which a colored filter is formed.

19. The method of selecting a hair dye according to claim 18, wherein a reflected image, from said part of said mirror on which said colored filter is formed, of said hair having a color substantially the same as said dyed hair color, and a reflected image, from a part of said mirror on which no colored filter is formed, of said hair having the actual present color of said hair, are obtained simultaneously.

* * * * *